US008833758B2

(12) United States Patent
Salamone

(10) Patent No.: US 8,833,758 B2
(45) Date of Patent: Sep. 16, 2014

(54) STACKER

(75) Inventor: John Salamone, Kinnelon, NJ (US)

(73) Assignee: Vits America, Inc., Blauvelt, NY (US)

( * ) Notice: Subject to any disclaimer, the term of this patent is extended or adjusted under 35 U.S.C. 154(b) by 0 days.

(21) Appl. No.: 13/573,360

(22) Filed: Sep. 10, 2012

(65) Prior Publication Data

US 2013/0221610 A1 Aug. 29, 2013

Related U.S. Application Data

(60) Provisional application No. 61/533,177, filed on Sep. 9, 2011.

(51) Int. Cl.

| | |
|---|---|
| ***B65H 29/26*** | (2006.01) |
| ***B65H 5/02*** | (2006.01) |
| ***B65G 47/26*** | (2006.01) |
| ***B65G 47/28*** | (2006.01) |

(52) U.S. Cl.
USPC ..... 271/191; 271/275; 198/459.8; 198/459.1; 198/460.2

(58) Field of Classification Search
USPC ..... 271/189–191, 182, 216, 275, 3.18, 3.2, 271/3.21; 100/7; 414/789.9, 790.3; 198/588, 812, 460.2, 461.1–461.3, 198/594, 459.1–459.8
See application file for complete search history.

(56) References Cited

U.S. PATENT DOCUMENTS

| | | | | |
|---|---|---|---|---|
| 4,281,757 | A * | 8/1981 | Morton | 198/358 |
| 4,881,635 | A * | 11/1989 | Raschke | 198/460.2 |
| 5,855,368 | A * | 1/1999 | Middelberg et al. | 271/272 |
| 6,295,922 | B1 * | 10/2001 | Salamone et al. | 100/7 |
| 2012/0282074 | A1 * | 11/2012 | Thies et al. | 414/789.9 |

* cited by examiner

*Primary Examiner* — Patrick Cicchino
(74) *Attorney, Agent, or Firm* — Leason Ellis LLP

(57) ABSTRACT

A stacking system for stacking paper from a linear feed.

5 Claims, 7 Drawing Sheets

STACKER

CROSS-REFERENCE TO RELATED APPLICATION

This application claims the benefit of U.S. Provisional Application No. 61/533,177, filed Sep. 9, 2011, which is hereby incorporated by reference herein in its entirety for all purposes.

FIELD OF THE INVENTION

The present invention relates to equipment used in the processing of cut sheets of material (e.g. cut sheets of paper), and, more particularly, to a stacker for stacking cut sheets of material.

BACKGROUND OF THE INVENTION

Stackers are used in the printing industry to collect a flat, linear feed of cut sheets of paper, e.g. that are being feed over belts in a shingled configuration (i.e., overlapping with a slight overhang between successive sheet). In order to efficient handle and ship the sheets at the end of the printing and cutting process, they must be collected from the linear feed and stacked on top of each other. Typically, the individual sheets are stacked into a particular number of sheets per stack (e.g., 100 sheets per bundle). A typical stacker has a set of in feed belts that feed 25 the linear sheets into the machine and second set of belts that creates a break in the feed of sheets through the machine. As the linear sheets are passed over the second set of belts speeds they speed up after the desired number of sheets has passed over the second belts. This speeding up of the second belts creates a gap in the feed of linear sheets. This gap can be used to separate the sheets in a stack so that the stack has the desired number of sheets. However, this speeding up of the second belts, without additional handling, can cause problems in the processing of the sheets because they may become unaligned.

The present invention addresses this and other issues.

SUMMARY

A stacking system for stacking a plurality of sheets of material that are feed into the system in a linear feed is provided. The system includes a pulley that can move in the direction of a feed to create a gap in the feed. The system also includes a first set of blades that can move in a first direction and a second set of blades that can move in a second direction, wherein the first and second set of blade are interleaved in an extended position of the first set of blades and a up position of the second set of blades.

DESCRIPTION OF CERTAIN EMBODIMENTS OF THE INVENTION

Figure 1:
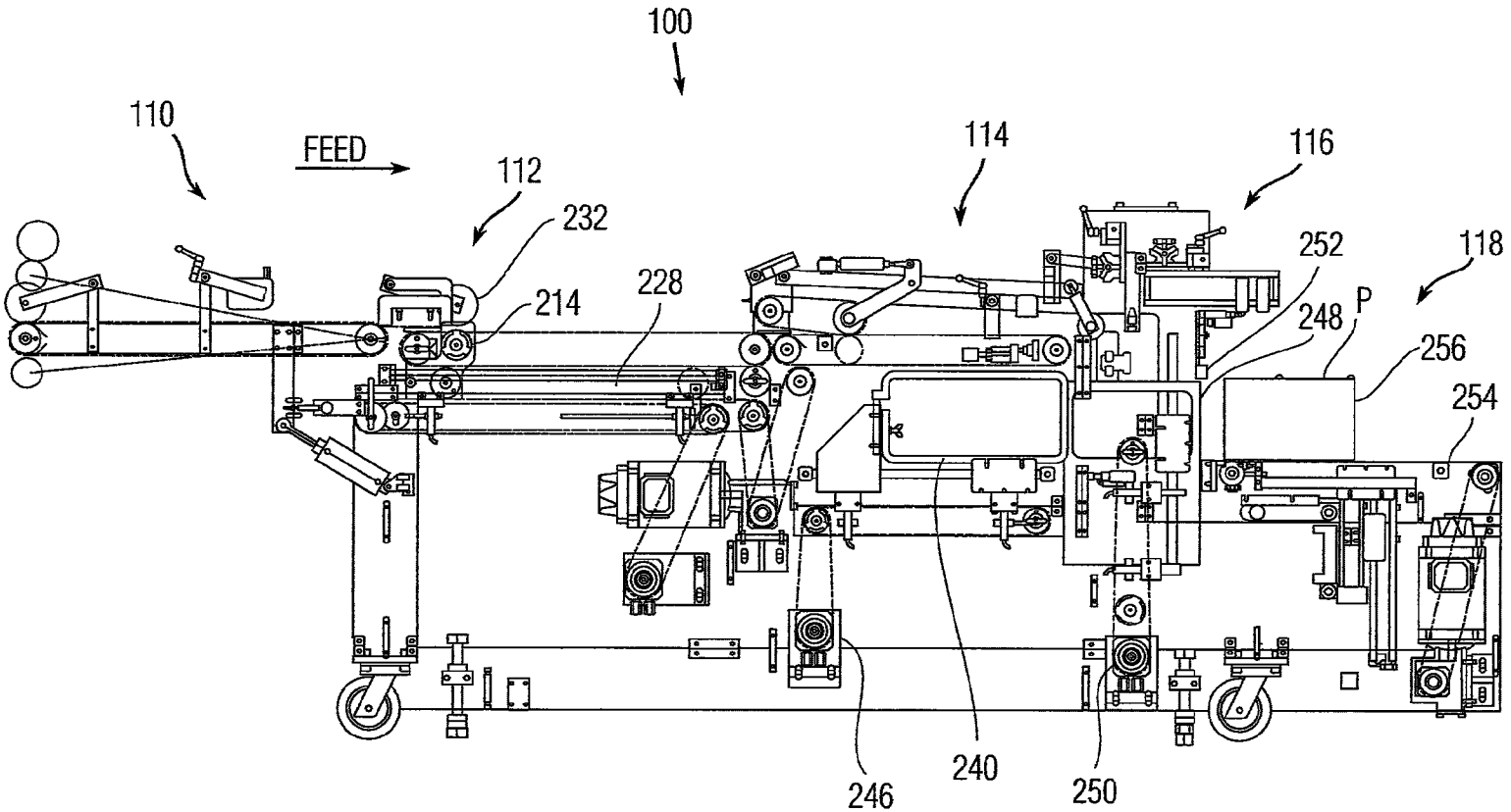
FIG. 1 is a schematic view of the stacker according to an embodiment of the invention.

Referring to FIG. 1, the stacker 100 includes an intake system 110, a gap control system 112, a conveyor system 114, a stacking system 116, and an outfeed system 118.

Figure 2:
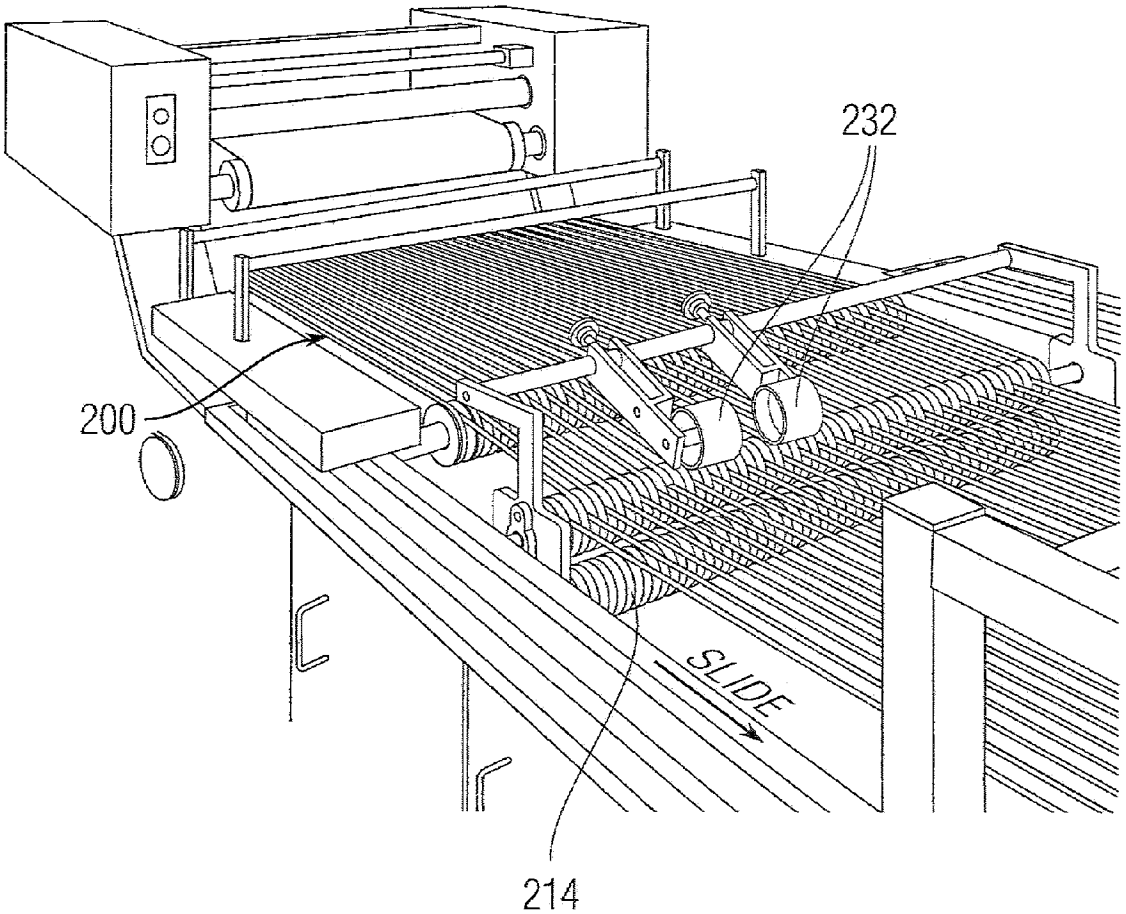
FIG. 2 is a an isometric view of the stacker.

Referring to FIGS. 1 and 2, the intake system 110 a plurality of cylinder pulleys that include belts that that feed the shingled paper into the stacker 100. The shingled sheets are then feed into the gap control system 112.

Figure 3:
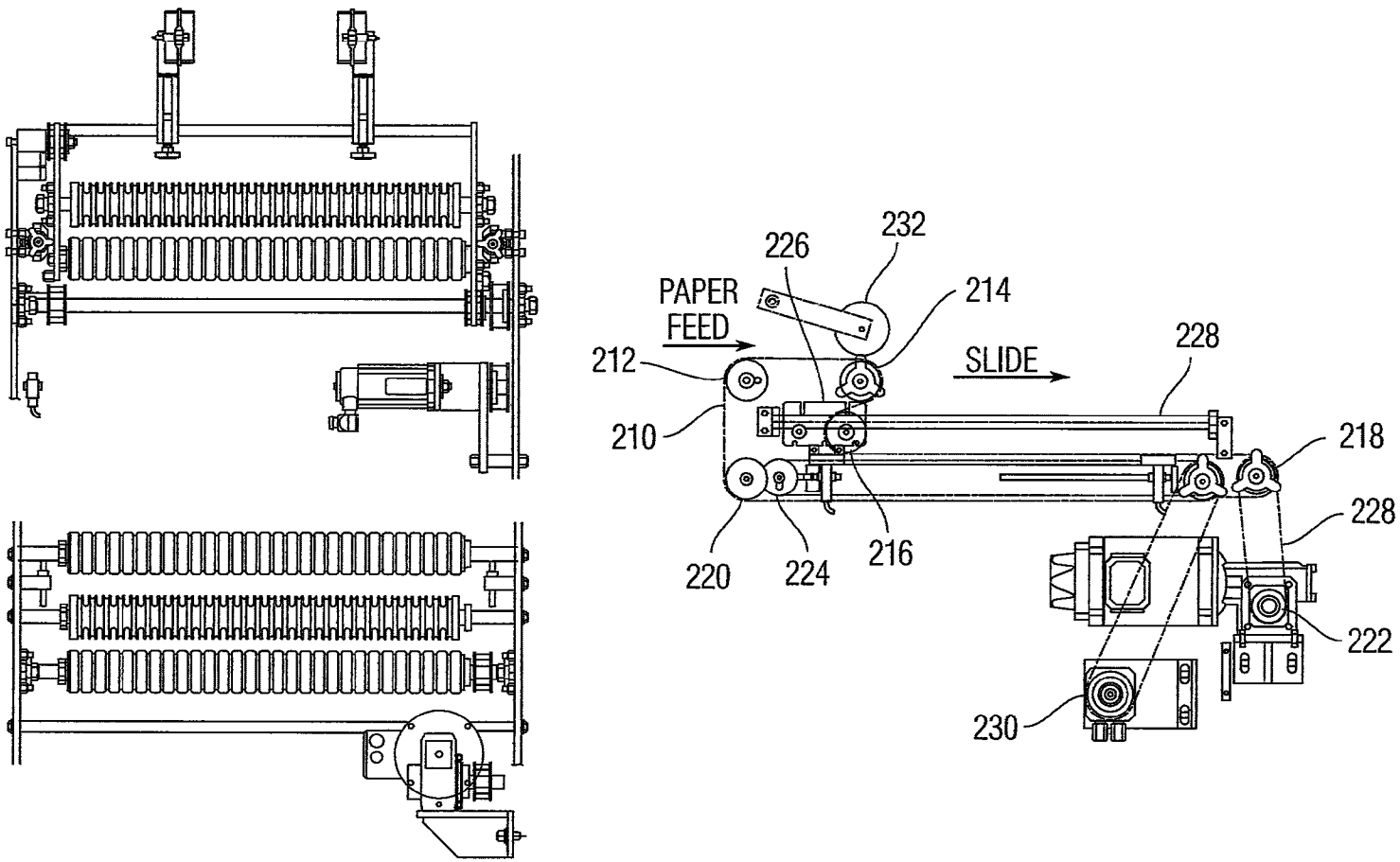
FIG. 3 is a schematic view a gap creating system of the stacker.
Figure 4:
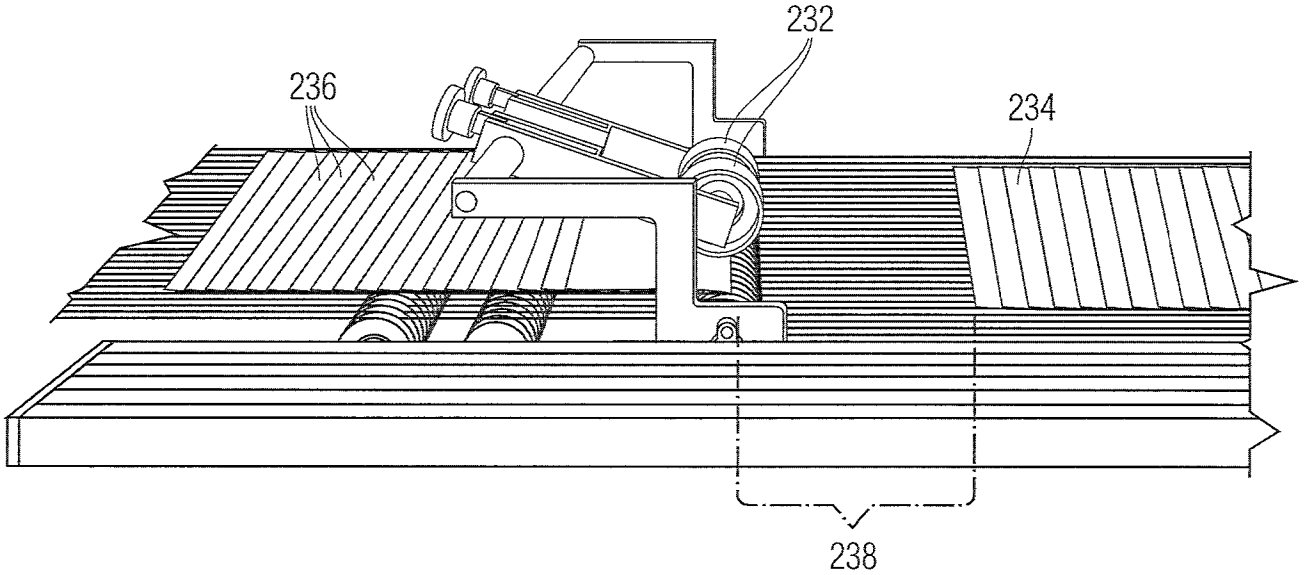
FIG. 4 is an isometric view a gap creating system of the stacker.
Figure 5:
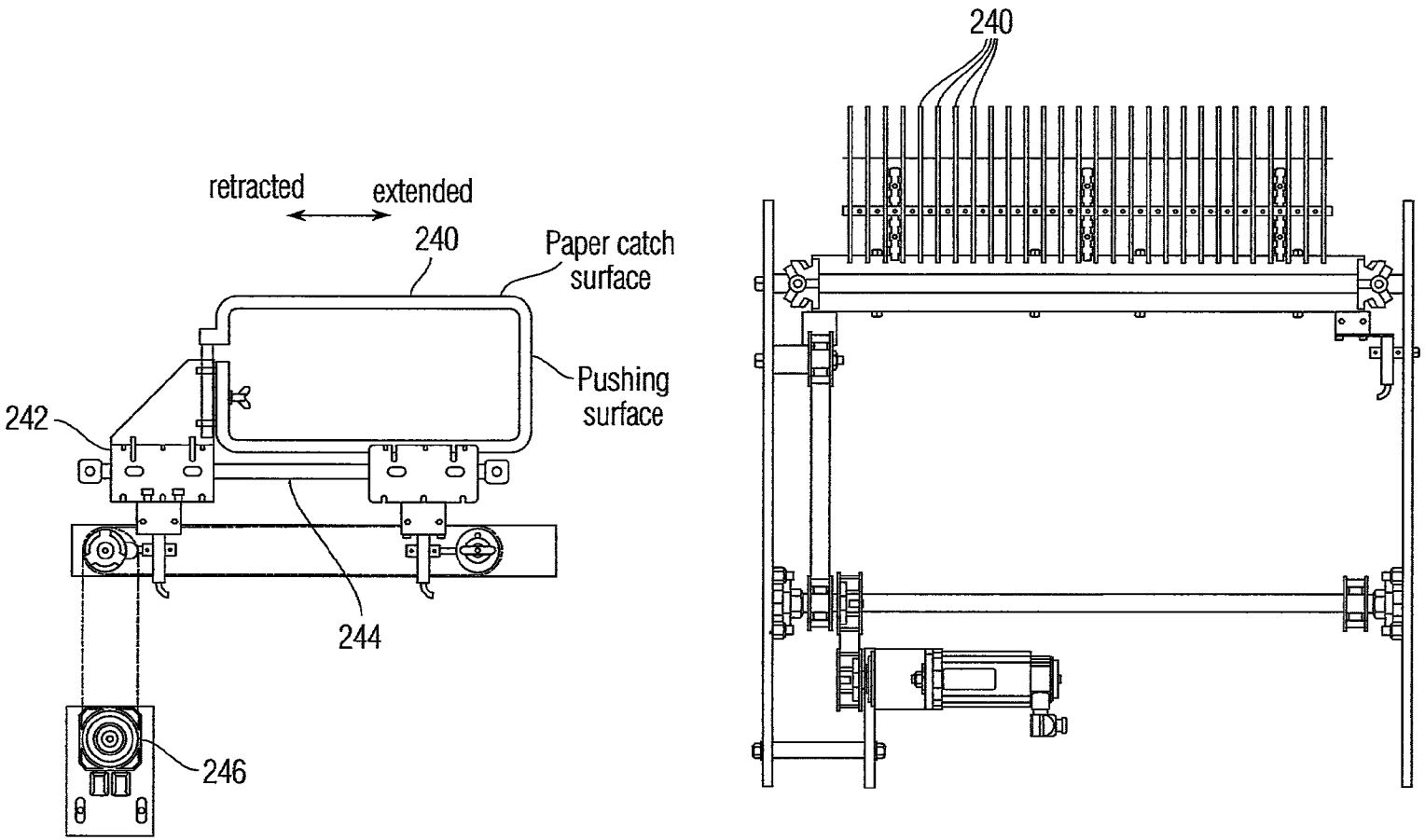
FIG. 5 is a schematic view a stack creating system of the stacker.

Referring to FIGS. 1, 2 and 3, the shingled paper is feed onto belt 210 as illustrated by the paper feed arrow. Belt 210 wraps around cylinders 212, 214, 216, 218, and 220. The speed of the belt is controlled by servo 222 via belt 228. The belt 210 moves at the line speed of the paper being fed between pulley 214 and nip pulleys 232. Pulleys 214 and 216 and nip pulleys 232 are mounted on slide 226. Slide 226 can slide along slide bar 228. Accordingly, pulleys 214 and 216 and nip pulleys 232 can move along the slide. When the predetermined number of sheets of paper pass through pulley 214 and nip 232, pulleys 214 and 216 and nip pulleys 232 are moved along the slide at the speed the belt 210. Accordingly, the speeds of the slide and the belt are matched and the shingled sheets cease to move between the nip 232 and pulley 214 (i.e. the linear speed of the slide matches the linear feed of the belt so sheets are not passed). However, because the nip 232 and pulley 214 continue to linearly slide in the direction of the feed of sheets, the feed is not interrupted. As the sheets that have already passed between the nip 232 and pulley 214 are fed onto conveyor system 114 the belts of the conveyor system speed up to create a gap. The stacker can include a sensor (e.g., laser or optical than can count the number of shingled sheets passing through and/or a change in indicia on the sheers (e.g., a zip code). Once a predetermined number of sheets passes through, the belts of the conveyor system 114 speed up faster than the line speed. Thus, a gap 238 is created between those sheets 234 that have passed between the pulley 214 and nip 232, and those sheets 236 that have not yet passed completely through. After" the gap 238 is created, the nip 232 and pulley 214 traverse along the slide in the opposite direction, thereby resulting the belt to resume moving again and therefore allowing sheets to pass through.

Figure 6:
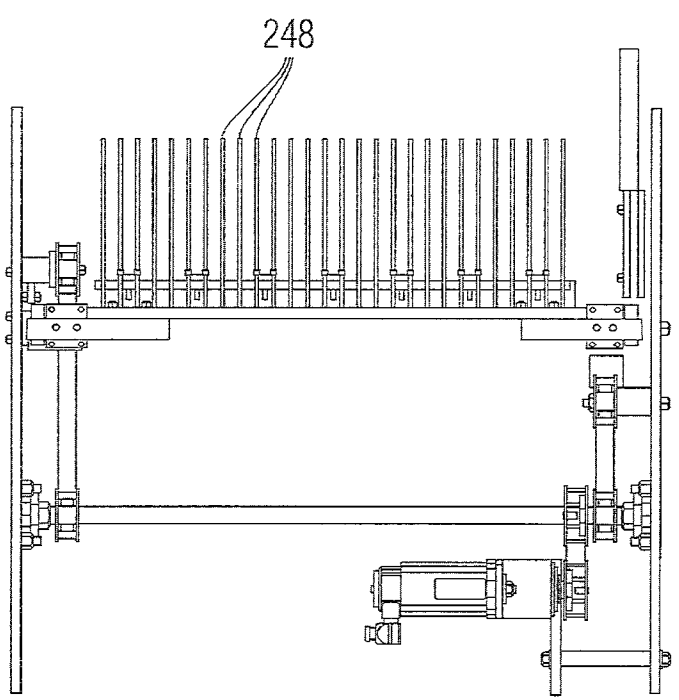
FIG. 6 is a schematic view a stack creating system of the stacker.
Figure 7:
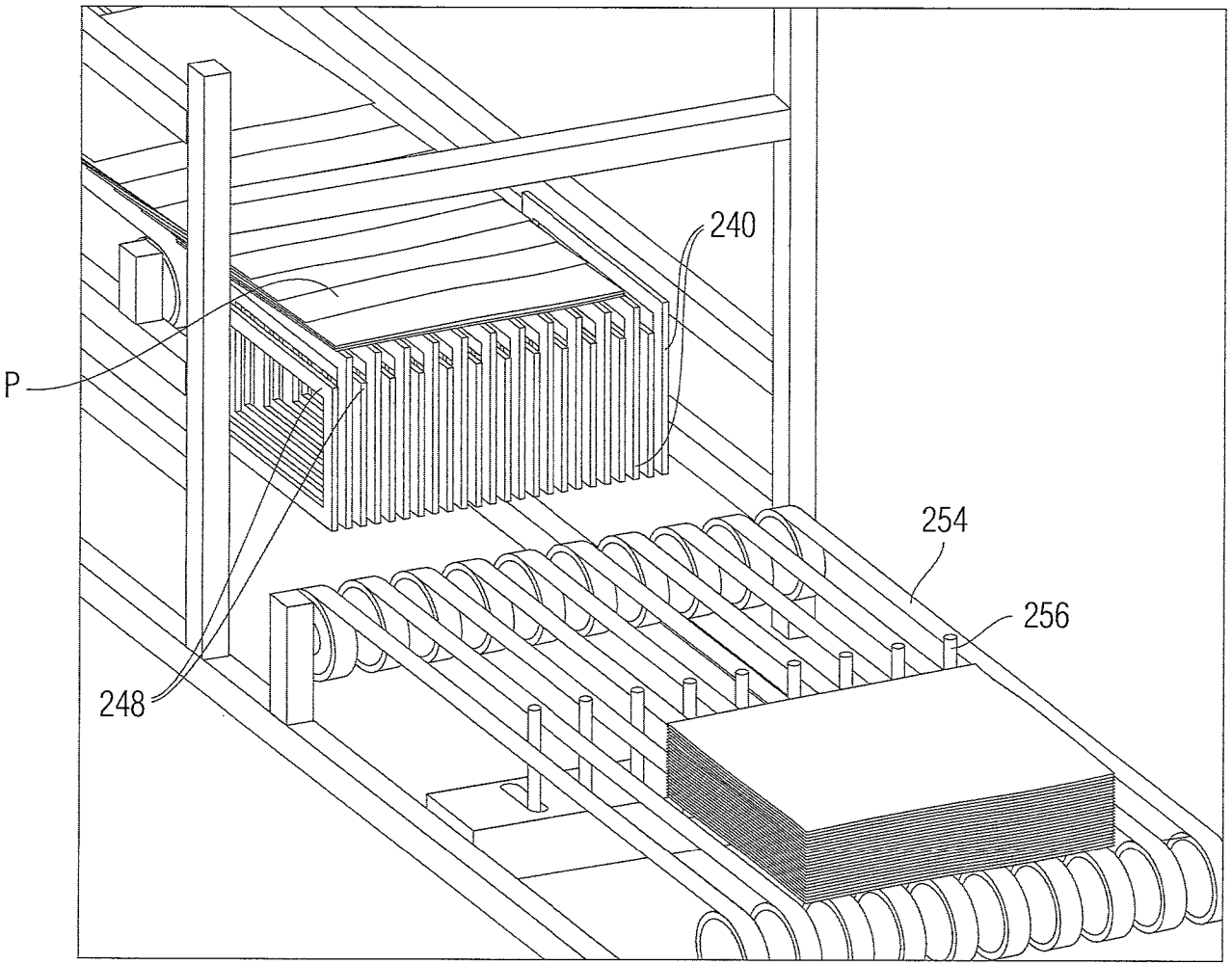
FIG. 7 is an isometric view a stack creating system of the stacker.

The sheets are then conveyed onto the stacking system 116. The sheets are conveyed off the belts of the conveyor system 114 and they are then vertically deposited onto a plurality of pusher blades 240. Referring to FIGS. 1 and 6-7, the pusher blades 240 are mounted on a slide 242 that slides along slide bar 244 as controlled by servo motor 246. The pusher blades 240 are interlaced with a plurality of table blades 248 when the pusher blades are in the extended position and the table blades are in the up position. The table blades 248 are moved vertically up and down via servo motor 250. FIG. 7 shows the pusher blades 240 are shown in an extended position and the table blades 248 in an up position. The sheets of paper deposited from the conveyor 114 onto the pusher blades 240 because the pusher blades are slightly taller than the table blades 248. Stop 252 ensures that the sheets of paper form a stack on top of the pusher blades 240. As the gap 238 in the linear, shingled sheets of paper (or other sheet material) approaches the stacking system 116, the pusher blades are moved by the servo 246 into the retracted position as shown in FIG. 1. As the pusher blades 240 are retracted, the stack of paper P drops onto the slightly shorter table blades 248. When the last sheet of paper in the stack (i.e., the last sheet of paper before the gap) lands on the table blades 248, the servo 250 moves the table blades 248 down so that the stack of paper P lands is level with conveyor belts 254 of the outfeed system 118. The pusher blades 240 are then moved to the extended position, which pushes the stack of paper P onto the belts 254. The outfeed system also includes a plurality of fingers 256 that can be moved up and down by a servo motor. The fingers are shown in the up position in FIG. 1. As the pusher blades 240 extend, the stack of paper P is pushed against the extending fingers 256. This ensures the Individual sheets are stacked neatly. After the pusher blades are fully extended, the fingers 256 move down so that they are below the belts 254, which then move the stack of paper P to the end of the stacker 100 for collection. In addition, the movement of the pusher blades 240 back into the extend position is timed with the next sheet of paper after the gap in the linear feed being dropped into the stacking system 116. Accordingly, the pusher blades 240 simultaneously extend to push the stack of papers P and to be in position to catch the next feed of papers (after the gap) that will form the next stack. In addition, pusher blades are returned to the extended position, the table blades are moved back to the up position. An optical sensor can monitor the linear feed and detect the position of the gap in the paper feed, which is then used to time the actuation of the pusher servo 246 and the table servo 250.

The stacker is controlled by a computer that includes a processor and memory and software that is executed by the processor. The computer receives information from sensors that detected the number of sheets that have passed through the feed (and thereby actuate the gap system 112 to create a gap in the feed) as well as detect the formed gap and control the operation of the servos of the stacking system 118.

Accordingly, as the stacker 100 is run, a linear feed of shingled paper can be gapped by the gap system 112 and then stacked by the stacking system 116 in a repetitive fashion. The pulley 214 and nip 232 is shuttled back and forth on its slide to produce gaps at a set interface of sheets being thread through the system, and the pusher blades 240 and table blades 248 are repetitively moved to collect the stack of papers (defined as the number of sheets between successive gaps) and pusher then to the exit of the machine.

While the invention has been described in connection with a certain embodiment and variations thereof, the invention is not limited to the described embodiment and variations but rather is more broadly defined by the recitations in the claims below and equivalents thereof.

What is claimed is:

1. A stacking system for stacking a plurality of sheets of material that are fed into the system in a linear feed, comprising:

a first feed surface capable of supporting the plurality of sheets, the first feed surface moving at a first speed;

a pulley connected to a support and disposed above the first feed surface, wherein the pulley is capable of moving in the direction of a feed to create a gap in the feed wherein the pulley has a first condition in which the pulley is stationary and the plurality of sheets passes beneath the pulley and a second condition in which the pulley moves in the feed direction at the same speed as the first speed of the first feed surface;

a second feed surface capable of supporting the plurality of sheets, wherein the second feed surface has a first condition in which it moves at a speed equal to the first speed of the first feed surface, and a second condition in which the second feed surface moves at a second speed that is faster than the speed of the first feed surface to separate the plurality of sheets into a first portion and a second portion;

a first set of blades that can move in a first direction;

a second set of blades that can move in a second direction that is different from the first, wherein the first and second set of blades are interleaved in an extended position of the first set of blades and a up position of the second set of blades.

2. A stacking system as in claim 1, wherein the support in the second condition moves at the same speed of the first feed surface wherein the sheets of the plurality of sheets beneath the pulley do not move with respect to the pulley.

3. A stacking system as in claim 1, wherein the second set of blades is in a raised position in a first condition in which sheets of material are received thereon and wherein the first set of blades are in a lower position in a second condition.

4. A stacking system as in claim 3, wherein the first set of blades is in a retracted position in a first condition and an extended position in a second condition in which the first set of blades is in the lower position such that the movement of the second set of blades from the retracted position to the extended position pushes sheets of material disposed on the first set of blades off the first set of blades.

5. A stacking system as in claim 4, wherein the first set of blades receives sheets of material thereon in the extended position and wherein the second set of blades are in the lower position.

* * * * *